United States Patent [19]

Naito et al.

[11] Patent Number: 4,816,363

[45] Date of Patent: Mar. 28, 1989

[54] PHOTOGRAPHIC ELEMENT

[75] Inventors: Hideki Naito; Hiroyuki Ozaki, both of Minami-ashigara, Japan

[73] Assignee: Fuji Photo Film Co., Ltd., Kanagawa, Japan

[21] Appl. No.: 837,128

[22] Filed: Mar. 7, 1986

[30] Foreign Application Priority Data

Mar. 8, 1985 [JP] Japan ..... 60-46042

[51] Int. Cl.[4] ..... G03C 5/54; G03C 1/76; G03C 1/82

[52] U.S. Cl. ..... 430/69; 430/62; 430/63; 430/203; 430/523; 430/527; 430/617; 430/619

[58] Field of Search ..... 430/62, 63, 69, 527, 430/530, 203, 617, 619, 523

[56] References Cited

U.S. PATENT DOCUMENTS

| | | | |
|---|---|---|---|
| 3,743,608 | 7/1973 | Habu et al. | 430/527 |
| 3,748,137 | 7/1973 | Worth et al. | 430/619 |
| 3,847,838 | 11/1974 | Habu et al. | 430/527 |
| 4,120,722 | 10/1978 | Okamoto et al. | 430/619 |
| 4,409,316 | 10/1983 | Zeller-Pendley et al. | 430/262 |
| 4,643,964 | 2/1987 | Sawada et al. | 430/203 |
| 4,710,450 | 12/1987 | Naito | 430/203 |

*Primary Examiner*—Richard L. Schilling

*Attorney, Agent, or Firm*—Sughrue, Mion, Zinn, Macpeak & Seas

[57] ABSTRACT

In a photographic element amenable to heat development or mobile dye heat transfer, an electroconductive layer is formed from a composition containing an electroconductive substance, typically carbon black, a hydrophilic binder, typically gelatin, and a water-insoluble compound having a melting point of up to 120° C. and a boiling point of at least 175° C., for example, trinonyl phosphate, such that the conductive layer undergoes a minimized change in electric resistance when folded.

8 Claims, No Drawings

PHOTOGRAPHIC ELEMENT

BACKGROUND OF THE INVENTION

This invention relates to a photographic element for use in a process for forming an image, for example, through heat development, and more particularly, to such a photographic element having an electroconductive layer.

Heat developable photosensitive materials and heat development process are well known in the art and described in the literature, inter alia, "Fundamentals of Photographic Engineering", Corona Publishing K.K., Tokyo, Japan (1979), pages 553–555; "Image Information", April 1978, page 40; Nebletts Handbook of Photography and Reprography, 7th ed., Van Nostrand Reinhold Company, pages 32–33; U.S. Pat. Nos. 3,152,904, 3,301,678, 3,392,020, and 3,457,075; British Pat. Nos. 1,131,108 and 1,167,777; and Research Disclosure, June 1978, pages 9–15 (RD-17029).

A process for transferring a mobile dye imagewise formed by heat development to an image-receiving layer by heating and image-receiving materials used therefor are described in Japanese Patent Application Kokai Nos. 58-58543, 58-79247, and 59-168439, inter alia.

Heating of these heat-developable photosensitive materials and image-receiving materials (both generally referred to as photographic materials, hereinafter) may be carried out by a number of methods including contacting of photographic materials with a heat block having a great capacity; direct heating of photographic materials by laser and infrared irradiation, ultrasonic heating, high frequency heating or the like; and passing of photographic materials through heated gas. These methods are, however, not successful in achieving satisfactory results because of their shortcomings. For instance, the use of a heat block is time and power consuming to accomplish a uniform temperature distribution throughout the heat block, and insufficient contact prevents smooth uniform heat transfer to the photographic material. The use of radiation like laser beam is disadvantageous in that a large sized apparatus is required or a compact system is difficult to incorporate. The use of heated gas is time consuming because of the gas has essentially a low heat capacity.

To overcome these shortcomings, the use of an exothermic electroconductive layer in combination with a heat developable photosensitive layer was proposed as disclosed in, for example, U.S. Pat. No. 206,368 and Japanese patent application Kokai No. 48-66442.

Also, a variety of positive electroconductive layers (which herein designate electroconductive layers whose electric resistance increases with a temperature rise) intended for plane heaters were developed as disclosed in, for example, Japanese patent application Kokai Nos. 49-82734, 49-82735, 51-13991, 51-39742, 51-39743, and 52-87694.

These methods aim to prevent overheating by taking advantage of the nature of these materials that their electric resistance increases with a temperature rise and have been applied as plane heaters and snow melting systems. It is possible to apply these positive electroconductive layer to photographic materials as described in, inter alia, Japanese patent application No. 58-229377.

Any desired choice of design may be made on an exothermic electroconductive layer so as to meet the intended application whether it is of the positive type as mentioned above, of the negative type wherein the electric resistance of an electroconductive layer decreases with a temperature rise, or of the neutral type wherein resistance does not depend on temperature. With respect to a binder used in such a layer, a choice may be made between hydrophilic binders and hydrophobic polymeric binders combined with organic solvents, depending on the desired properties of the electroconductive layer.

An attempt has been made to employ hydrophilic colloid as a binder in the electroconductive layer. However, electroconductive layers containing typical hydrophilic colloids, gelatin and polyvinyl alcohol tend to change their electric resistance when folded or bent. Such a change in electric resistance is undesirable because it can positively reveal itself as irregularities in a heat developed or heat transferred image. It is known that this phenomenon becomes outstanding particularly when the electroconductive material used is a carbon black having a dibutyl phthalate (DBP) absorption of at least 100 which is preferably used as it undergoes a little resistance change by ambient humidity. There is the need for further improvement in this respect.

SUMMARY OF THE INVENTION

An object of the present invention is to provide a novel and improved photographic element which is capable of satisfactory heat development or heat transfer of a mobile dye and experiences a minimized change in electric resistance when folded.

According to the present invention, there is provided a photographic element comprising on a support an electroconductive layer containing at least an electroconductive substance, a hydrophilic binder, and a water-insoluble compound having a melting point of up to 120° C. and a boiling point of at least 175° C.

DETAILED DESCRIPTION OF THE INVENTION

The photographic element of the present invention comprises an electroconductive layer (to be simply referred to as a conductive layer, hereinafter). The conductive layer contains at least a conductive substance, a hydrophilic binder, and a water-insoluble compound.

The conductive layer of the photographic element according to the present invention contains a water-insoluble compound, preferably in the form of fine droplets. The water-insoluble compounds used herein should have a melting point of up to 120° C., preferably up to 50° C. and a boiling point of at least 175° C., preferably at least 200° C. Those water-insoluble compounds having a melting point of higher than 120° C. fail to reduce the variation of electric resistance upon folding whereas those having a boiling point of lower than 175° C. would readily volatize upon heating.

The water-insoluble compounds are preferably present in the form of fine droplets having a size of up to 2 μm. Droplets of more than 2 μm in size are undesirable because they tend to emerge or ooze on the surface.

Some illustrative, non-limiting examples of the water-insoluble compounds used herein include phthalates such as dibutyl phthalate, dicyclohexyl phthalate, di-2-ethylhexyl phthalate, didodecyl phthalate, etc.; phosphates and phosphonates such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.; benzoates such as 2-ethylhexyl benzoate, dodecyl benzoate, 2-ethylhexyl-p-hydroxybenzoate, etc.; amides such as diethyldodecane amide, N-tetradecylpyrrolidone, etc.; alcohols and phenols such as isostearyl alcohol, 2,4-di-tert-aminophenol, etc.; aliphatic carboxylates such as dioctyl azelate, glycerol tributyrate, isostearyl lactate, trioctyl citrate, etc.; aniline derivatives such as N,N-dibutyl-2-butoxy-5-tert-octylaniline, etc.; hydrocarbons such as paraffins, dodecylbenzene, diisopropylnaphthalene, etc., and the like. Also employable are edible oils such as salad oils and fry oils.

The water-insoluble compound is prefereably used in amounts of about 0.01 to about 3 folds, more preferably about 0.05 to about 2 folds the weight of the hydrophilic binder as will be described hereinafter. Amounts below the lower limit of about 0.01 fold or 1% of the weight of the hydrophilic binder are too small to reduce the resistance variation upon folding whereas amounts above about three folds make it difficult to form a uniform stable film.

The conductive layers of the present invention also contain a conductive substance.

Typical examples of the conductive substances include metals such as iron, copper, silver, nickel, platinum, etc., alloys such as those alloys based on nickel and/or chromium also known as Nichrome and Kanthal; noble metal alloys such as platinum-rhodium alloys, silicon carbide, molybdenum silicide, and oxide semiconductors such as zirconia ($ZrO_2$), zinc oxide, titanium dioxide, and thoria ($ThO_2$), graphite and carbon black. Most preferred among these are graphite and carbon black because of their low cost. Conductive carbon black is known among the carbon black species while any types of carbon black may be equally employed. These types of carbon black are described in Carbon Black Annual and J. B. Donnet & A. Voet, "Carbon Black", Marcel Dekker (1976), and commercially available from Columbian Carbon Company, Mitsubishi Chemical Industry K.K., and other manufacturers.

Preferred among these types of carbon black are those having a dibutyl phthalate (DBP) oil absorption of more than 80 cc/100 grams as measured by Procedure A or B prescribed in JIS K 6221. These preferred carbon blacks are readily chosen and available from the carbon catalogs of Cabot Corporation, Lion Akzo K.K., Colombian Carbon Japan K.K., and other manufacturers. Some illustrative, but non-limiting examples are BLACK PEARLS 1300, BLACK PEARLS 1000, BLACK PEARLS 880, BLACK PEARLS 700, BLACK PEARLS 2000, VULCAN XC-72, VULCAN P, VULCAN 9, REGAL 300R, ELFTEX PELLETS 115, ELFTEX 8, ELFTEX 12, STERLING SO, and STERLING V all available from Cabot Corporation; KETJEN BLACK EC manufactured by Japan EC K.K. (marketed from Lion Akzo K.K.); ROYAL SPECTRA, NEO SPECTRA MARK I and II, NEO SPECTRA AG, SUPERBA (NEO MKII), NEO SPECTRA MARK IV, RAVEN 5000, RAVEN 7000, RAVEN 5750, RAVEN 5250, RAVEN 3500, RAVEN 3200, RAVEN 1040, RAVEN 890 POWDER, RAVEN 890H POWDER, RAVEN 825 BEADS, RAVEN 500, CONDUCTEX 40 220, CONDUCTEX 975 BEADS, CONDUCTEX 900 BEADS, CONDUCTEX SC, RAVEN H20 POWDER, RAVEN C BEADS, RAVEN 22 POWDER, RAVEN 16 POWDER, and RAVEN 14 POWDER all available from Columbian Carbon Japan K.K.

Conductive layers containing such carbon black having a high DBP oil absorption vary substantially little their resistance with a change of ambient humidity. More the DBP oil absorption, more outstanding is the effect. In the preferred embodiment of the present invention, carbon blacks are used having a DBP oil absorption of more than 100 cc/100 grams, most preferably more than 150 cc/100 grams.

In the conductive layers according to the present invention, polymers falling outside the above-specified scope may be used as a binder in combination with the high molecular weight compounds as defined above.

The binders used in the conductive layer in the practice of the present invention are hydrophilic. The hydrophilic binders are typically transparent and translucent hydrophilic colloids, for example, natural substances, for example, proteins such as gelatin, gelatin derivatives, cellulose derivatives, etc. and polysaccharides such as starch and gum arabic, and synthetic polymers, for example, water-soluble polyvinyl compounds such as polyvinyl alcohol and polyvinyl pyrrolidone and acrylamide polymers. Particularly useful among them are gelatin and polyvinyl alcohol, with gelatin being most preferred.

Hydrophilic conductive high-molecular weight compounds may also be used as the binder, which have both the functions of a conductive substance and a hydrophilic binder. Exemplary of the conductive high-molecular weight compounds there may be given cationic high-molecular weight electrolytes such as polypiperidinium chloride, polyvinylbenzyl trimethylammonium chloride, etc.

It is also possible to use conductive fine particles in admixture with conductive high-molecular weight compounds.

The conductive films formed from the conductive fine particles and the conductive high-molecular weight compounds individually or in admixture of any two or more of them have an electric resistance which may be controlled to any desired value by a suitable choice of the ratio of conductive material to binder, dispersion method, the particular type of binder used or the like. Such control is well known in the art and described in the afore-mentioned literature and technical documents of carbon black manufacturers. Preferably, the conductive layers have a volume resistance of 0.01 to 10 Ω-cm, more preferably 0.1 to 1 Ω-cm.

The amount of the conductive component used in the conductive layers generally ranges from 10 to 90% by weight, preferably from 15 to 85% by weight. Better results are obtained particularly when carbon black is used in an amount of about 0.1 to about 50 grams/$m^2$, preferably about 0.5 to about 20 grams/$m^2$ as the conductive substance. In this case, the content of carbon black in the conductive layer ranges from about 10 to about 90% by weight, preferably from about 15 to about 80% by weight.

The conductive layer thus constructed preferably has a thickness of up to about 15 μm.

The photographic element of the present invention is applicable to not only heat-developable photosensitive materials comprising a photosensitive silver halide, binder, organic silver salt oxidizing agent, and reducing agent on a support for producing black and white images, but also heat-developable photosensitive materials comprising a photosensitive silver halide, binder, and a dye-providing substance capable of producing or releasing a mobile dye in direct or counter proportion to the reduction of the photosensitive silver halide to silver at elevated temperatures on a support for producing color images, as well as image-receiving materials or dye-fixing materials for receiving the mobile dye produced or released from these color image-producing heat-developable photosensitive materials under heat through transfer mechanism.

In the practice of the present invention, the conductive layer and the photographic layer including photosensitive and image-receiving layers may be provided on the same or opposite sides of a support. Alternatively, they may be provided on separate supports wherein the conductive layer on one support may be placed on the photosensitive or image-receiving material on the other support into an integral assembly at any appropriate point of time. That is, any form may be taken insofar as heat produced by electric conduction is transferred to the photographic layer to heat it to a temperature necessary for development or image transfer. It is preferred to apply the conductive and photographic layers on opposite sides of a common support because the resulting photographic material is given a better curling balance. This arrangement is particularly preferred when the binder used in the conductive layer is water soluble because the resulting photographic material has layers of the same type formed on opposite sides of a support.

Some illustrative, but non-limiting arrangements of the conductive layers and the photosensitive or image-receiving layers are:

conductive layer/support/photosensitive or image-receiving layer;

support/photosensitive or image-receiving layer/-conductive layer, and support photosensitive or image-receiving layer/intermediate layer/conductive layer.

The silver halides used in the present invention include silver chloride, silver bromide, silver iodide, silver chlorobromide, silver chloroiodide, silver iodobromide, and silver chloroiodobromide, but not limited thereto.

The silver halide grains may have a uniform halogen composition or a multiple structure varying in composition from the surface to the interior (see Japanese Patent Application Kokai Nos. 57-154232, 58-108533, 59-48755, and 59-52237; U.S. Pat. No. 4,433,048; and European Pat. No. 100,984). When a silver halide is used alone without combining an organic silver salt-oxidizing agent, the silver chloroiodide, iodobromide, and choroiodobromide in which the X-ray pattern of silver iodide crystals is observable may preferably be used. For example, silver iodobromide of such nature is prepared by first adding silver nitrate solution to potassium bromide solution to form silver bromide particles and then adding potassium iodide to the mixture. Also useful are plate particles having a thickness of up to 0.5 μm, a diameter of at least 0.6 μm, and an average aspect ratio of at least 5 (see U.S. Pat. No. 4,414,310 and 4,435,499 and German Patent Application (OLS) No. 3,241,646A1) and monodispersed emulsion having approximately uniform grain size distribution (see Japanese Patent Application Kokai Nos. 57-178235, 58-100846, and 58-14829, International Publication 83/02332A1, European Pat. Nos. 64,412A3 and 83,377A1). Silver halide grains of epitaxial junction type may also be used (see Japanese Patent Application Kokai No. 56-16124 and U.S. Pat. No. 4,094,684). More than one silver halide having different crystal habit, halogen composition, grain size, or grain size distribution may also be used in admixture. More than one monodispersed emulsion having different grain size may be mixed so as to regulate gradation.

The silver halide used in the present invention preferably has an average grain size of from 0.001 μm to 10 μm and more preferably from 0.001 μm to 5 μm.

For the purpose of improving high or low intensity reciprocity law failure, there may be employed water-soluble iridium salts such as iridium (III, IV) chlorides and ammonium hexachloroiridate, and water-soluble rhodium salts such as rhodium chloride.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The silver halide emulsions used in the practice of the present invention may be either of the surface latent image type wherein latent images are predominantly formed on the grain surface or of the internal latent image type wherein latent images are formed in the grain interior. Also employable is a direct reversal emulsion having an internal latent image type emulsion combined with a nucleating agent.

The amount of the photosensitive silver halide coated preferably ranges from 1 mg/m$^2$ to 10 g/m$^2$ of silver.

In the practice of the present invention, an organic metal salt which is relatively stable to light may be used as an oxidizing agent in combination with the photosensitive silver halide. It is necessary that the photosensitive silver halide and the organic metal salt be in contact with or close to each other. Preferred among these organic metal salts are organic silver salts. The organic metal salt incorporated in a heat-developable photosensitive material in combination with the silver halide is believed to participate in redox reaction by the catalysis of latent image-bearing silver halide when the heat-developable photosensitive material is heated to a temperature of at least 80° C., preferably at least 100° C.

Exemplary of the organic compounds which can be used to form the above-mentioned organic silver salt oxidizing agents, there may be given aliphatic and aromatic carboxylic acids, thiocarbonyl-containing compounds having a mercapto group or α-hydrogen, imino-containing compounds, and the like.

Useful examples of the organic silver salt oxidizing agent are those described in Japanese Patent Application Kokai No. 58-58543, page 19, left-lower column to page 20, right-upper column.

In the present invention, there may be contained a compound which, when the photosensitive silver halide is reduced into silver at elevated temperatures, produces or releases a mobile or diffusible dye in direct or inverse proportion to the reaction. These compounds are simply referred to as dye-providing substances hereinafter.

Typical of the dye-providing substances which can be used in the present invention are couplers capable of reacting with a developing agent. Coupler based systems are such that oxidation-reduction reaction of a silver salt with a developing agent gives an oxidized form of developing agent which in turn, reacts with a coupler to form a dye, and many such systems are described in the literature. Illustrative examples of the developing agents and couplers are described in detail in, for example, T. H. James, "The Theory of the Photographic Process", 4th Ed., pages 291–334 and 354–361, and S. Kikuchi, "Photographic Chemistry", 4th Ed., Kyoritsu Publishing K.K., pages 284–295. Another class of dye-providing substances includes dye-silver compounds in which an organic silver salt is combined with a dye. Examples of the dye-silver compounds are described in Research Disclosure, May 1978, pages 54–58 (RD-16966).

A further class of dye-providing substance includes azo dyes which are generally used in the heat development silver dye bleaching process. Examples of the azo dyes and the bleaching process are described in U.S. Pat. No. 4,235,957 and Research Disclosure, April 1976, pages 30–32 (RD-14433) inter alia. Leuco dyes as described in U.S. Pat. Nos. 3,985,565 and 4,022,617 are further examples of the dye-providing substances.

A still further example of the dye-providing substances is a compound having the function of releasing or diffusing a diffusible dye imagewise.

The compounds of this type may be represented by the following formula [L I]:

$$(\text{Dye-X})_n\text{-Y}$$

wherein Dye represents a dye group or a dye precursor group; X represents a simple bond or a connecting group; and Y represents a group which, in correspondence or counter-correspondence to photosensitive silver salt having a latent image distributed imagewise, produces a difference in diffusibility of the compound represented by $(\text{Dye-X})_n$-Y or releases Dye, the diffusibility of Dye released being different from that of the compound represented by $(\text{Dye-X})_n$-Y, and n represents an integer of 1 or 2, when n=2, the Dye-X's may be the same or different.

Exemplary of the dye-providing substances having general formula [L I] there may be given dye developing reagents in the form of a hydroquinone-type developing reagent having a dye moiety attached thereto as disclosed in U.S. Pat. Nos. 3,134,764; 3,362,819; 3,597,200; 3,544,545 and 3,482,972. In addition, substances which release a diffusible dye through intramolecular nucleophilic substitution reaction are disclosed in Japanese Patent Application Kokai No. 51-63618 and substances which releases a diffusible dye through intramolecular rewind reaction of an isooxazolone ring are disclosed in Japanese Patent Application Kokai No. 49-111628. In the systems to which these substances are applied, a diffusible dye is released or diffused where no development has taken place and no dye is released or diffused where development has taken place.

Since dvelopment and release or diffusion of the dye concurrently occur in these systems, it is very difficult to obtain an image having a high S/N ratio. In order to overcome this drawback, another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible dye. Typical examples of the dye-providing substances usable in such a system are described in Japanese Patent Application Kokai Nos. 53-110827, 54-130927, 56-164342, and 53-35533.

Also known are substances which release a diffusible dye where development has occurred. The substances which release a diffusible dye through the reaction of an oxidation product of a developing reagent with a coupler having a diffusible dye as an eliminatable group are described in British Pat. No. 1,330,524; Japanese Patent Publication No. 48-39165; U.S. Pat. No. 3,443,940 and the like, and the substances which produce a diffusible dye through the reaction of an oxidation product of a developing reagent with a coupler having an anti-diffusible group as an eliminatable group are described in U.S. Pat. No. 3,227,550 and the like.

The systems using these color developing agents have the serious problem that the resulting image can be contaminated with oxidation decomposition products of a developing agent. To overcome this problem, a dye-releasing compound has been proposed which itself has a reducing ability without the need for a developing reagent. Typical examples of these compounds are presented below together with the patent or literature disclosing them. The definition of legends in the formulas is given in the corresponding literature.

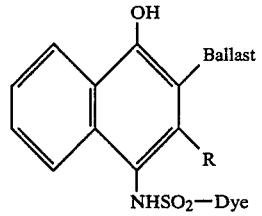

U.S. Pat. No. 3,928,312, etc.

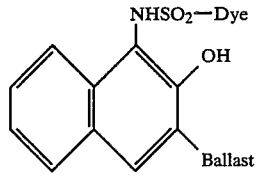

U.S. Pat. No. 4,053,312, etc.

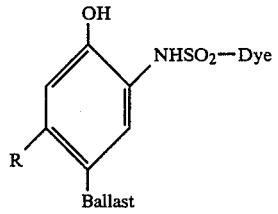

U.S. Pat. No. 4,055,428, etc.

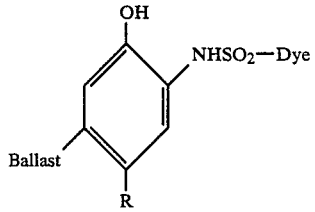

U.S. Pat. No. 4,336,322

-continued

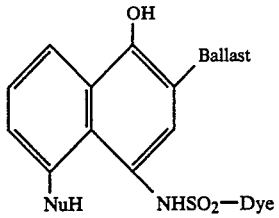

JP Pat. Appln. Kokai No. 59-65,839

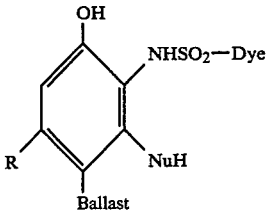

JP Pat. Appln. Kokai No. 59-69,839

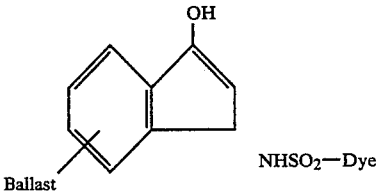

JP Pat. Appln. Kokai No. 53-3,819

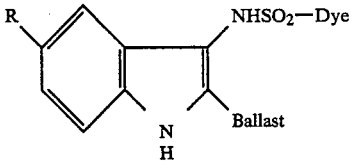

JP Pat. Appln. Kokai No. 51-104,343

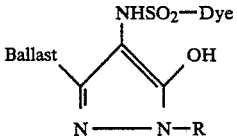

JP Pat. Appln. Kokai No. 51-104,343

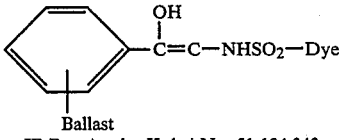

JP Pat. Appln. Kokai No. 51-104,343

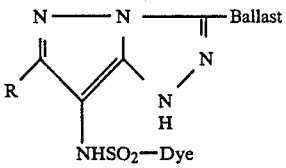

Research Disclosure, No. 17,465

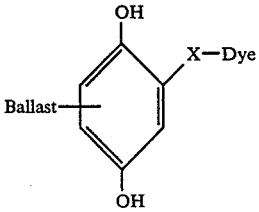

-continued

U.S. Pat. No. 3,725,062

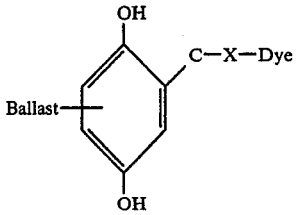

U.S. Pat. No. 3,728,113

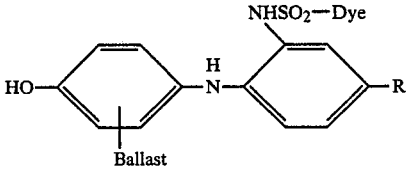

U.S. Pat. No. 3,443,939

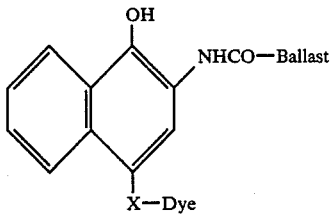

JP Pat. Appln. Kokai No. 58-116,537

Any of the foregoing dye-providing substances may be used in the practice of the present invention.

Illustrative examples of the image-forming substances which may be used in the practice of the present invention are described in the foregoing patents which are incorporated herein by reference. Since mentioning all the preferred compounds is impossible and redundant, some are given below by way of illustration. For example, the dye-providing substances represented by general formula [L I] include the following compounds.

Exemplary of the dye-providing substances which can be used in the practice of the present invention there may be given those compounds described in Japanese Patent Application Kokai No. 59-84236, pages 60–91, with the compounds identified therein as compound Nos. (1)–(3), (10)–(13), (16)–(19), (28)–(30), (33), (35), (38–40), and (42)–(64) being favorable among others. Also useful are the cyan and yellow dye-providing substances illustrated below.

Cyan dye-providing substance:

-continued

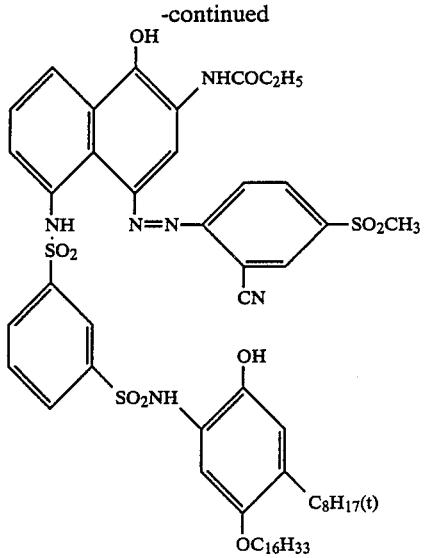

Yellow dye-providing substance:

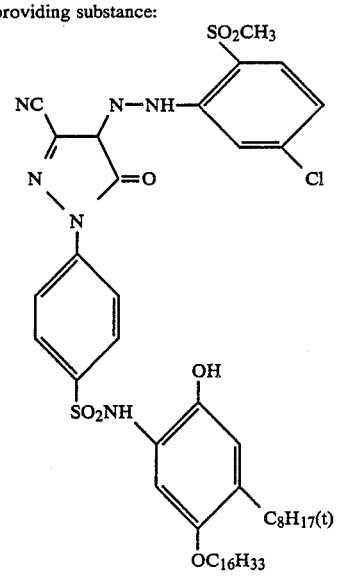

The above-illustrated compounds are only some examples of the useful dye-providing substances and not intended for limitation purpose.

In the practice of the present invention, the dye-providing substance may be introduced into a layer of photosensitive material by any well-known methods, for example, the method described in U.S. Pat. No. 2,322,027. In this case, an organic solvent having a high boiling point or an organic solvent having a low boiling point as described below may be used.

For example, the dye-providing substance is first dissolved in a high-boiling organic solvent, for example, a phthalic acid alkyl ester (such as dibutyl phthalate, dioctyl phthalate, etc.), a phosphoric acid ester (such as diphenyl phosphate, triphenyl phosphate, tricresyl phosphate, dioctylbutyl phosphate, etc.), a citric acid ester (such as tributyl acetylcitrate, etc.), a benzoic acid ester (such as octyl benzoate, etc.), an alkylamide (such as diethyl laurylamide, etc.), a fatty acid ester (such as dibutoxyethyl succinate, dioctyl azelate, etc.), and a trimesic acid ester (such as tributyl trimesate, etc.); or an organic solvent having a low boiling point of about 30° C. to 160° C., for example, a lower alkylacetate (such as ethyl acetate, butyl acetate, etc.), ethyl propionate, sec-butyl alcohol, methyl isobutyl ketone, β-ethoxyethyl acetate, methyl cellosolve acetate, cyclohexanone, etc. Mixtures of the above-described high boiling organic solvents and low boiling organic solvents may also be used. The solution of the dye-providing substance may then be dispersed in a hydrophilic colloid.

Further, it is possible to use a method for dispersion in polymers as described in Japanese Patent Publication No. 51-39853 and Japanese Patent Application Kokai No. 51-59943. Moreover, various surface-active agents may be used when the dye-providing substance is dispersed in a hydrophilic colloid. For this purpose, the surface-active agents illustrated in other part of the specification may be used.

The high-boiling organic solvent may be used in the practice of the present invention in amounts of up to 10 grams, preferably up to 5 grams per gram of dye-providing substance.

In order to provide a wide range of color within the chromaticity diagram using the three primary colors, yellow, magenta and cyan, the heat-developable photosensitive material used in the present invention should include at least three silver halide emulsion layers having sensitivity in different spectra.

Typical combinations of at least three silver halide emulsion layers having sensitivity in different spectra are a combination of blue-sensitive emulsion layer/green-sensitive emulsion layer/red-sensitive emulsion layer, a combination of green-sensitive emulsion layer/red-sensitive emulsion layer/infrared-sensitive emulsion layer, a combination of blue-sensitive emulsion layer/green-sensitive emulsion layer/infrared-sensitive emulsion layer, and a combination of blue-sensitive emulsion layer/red-sensitive emulsion layer/infrared-sensitive emulsion layer. By the infrared-sensitive emulsion layer used herein it is meant that the emulsion layer is sensitive to light having a wavelength of more than 700 nm, particularly more than 740 nm.

The heat-developable photosensitive materials of the present invention may have two or more emulsion layers having sensitivity in the same spectrum, but different in emulsion sensitivity.

Each of the above-mentioned emulsion layers and/or photo-insensitive hydrophilic colloid layer disposed adjacent thereto should contain either of a dye-providing substance which releases or forms a hydrophilic yellow dye, a dye-providing substance which releases or forms a hydrophilic magenta dye, and a dye-providing substance which releases or forms a hydrophilic cyan dye. Differently stated, each emulsion layer and/or a photo-insensitive hydrophilic colloid layer disposed adjacent thereto should contain a dye-providing substance which releases or forms a hydrophilic dye of different hue. If desired, mixtures of two or more dye-providing substances having the same hue may be used. When the dye-providing substance is originally colored, the heat-developable photosensitive material may preferably take such a layer arrangement as an arrangement of a blue-sensitive emulsion layer, a yellow dye-providing substance layer, a green-sensitive emulsion layer, a magenta dye-providing substance layer, a red-sensitive emulsion layer, and a cyan dye-providing substance layer, and an arrangement of a green-sensitive emulsion layer containing a yellow dye-providing substance, a red-sensitive emulsion layer containing a magenta dye-providing substance, and an infrared-sensitive emulsion layer containing a cyan dye-providing substance, both from the exposure radiation incident side.

In order to impart color sensitivity as mentioned above to the respective silver halide emulsions, each silver halide emulsion may be sensitized with a known sensitizing dye so as to provide the desired spectral sensitivity.

A reducing agent may desirably be used in the photosensitive material of the present invention. The reducing agents used herein include well-known reducing agents and the above-mentioned dye-providing substances having reducing ability. Also included are reducing agent precursors which themselves have no reducing nature, but exhibit reducing nature under the action of a nucleophilic agent or heat during the development process.

Examples of the reducing agents used herein include inorganic reducing agents such as sodium sulfite and sodium hydrogen sulfite, benzene sulfinic acids, hydroxylamines, hydrazines, hydrazides, boran-amine complexes, hydroquinones, aminophenols, catechols, p-phenylenediamines, 3-pyrazolidinones, hydroxytetronic acids, ascorbic acids, 4-amino-5-pyrazolones, etc. and the reducing agents described in T. H. James, "The Theory of the Photographic Process", the Fourth Edition, pages 291–334. Also usable are reducing agent precursors as disclosed in Japanese Patent Application Kokai Nos. 56-138736 and 57-40245, U.S. Pat. No. 4,330,617, and the like. Various combinations of developing reagents as described in U.S. Pat. No. 3,039,869 may also be used.

In the practice of the present invention, an image formation promotor may also be used. The image formation promotors have the functions of promoting such reaction as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, oils, thermal solvents, surface-active agents, and compounds capable of interacting with silver or silver ion. It should be noted that these compounds generally have multiple functions and thus possess some of the above-mentioned promoting effects combined.

The image formation promotors are illustrated for each of functional classes. However, this classification is made for convenience of description and actually, one compound often possesses more than one function in combination.

(a) Bases

Preferred examples of the bases include (1) inorganic bases, for example, hydroxides, secondary and tertiary phosphates, borates, carbonates, quinolinates, and metaborates of alkali metals and alkaline earth metals; ammonium hydroxides; quarternary alkyl ammonium hydroxides; and other metal hydroxides; and (2) organic bases, for example, aliphatic amines such as trialkyl amines, hydroxylamines, and aliphatic polyamines; aromatic amines such as N-alkyl-substituted aromatic amines, N-hydroxyl-alkyl-substituted aromatic amines and bis[p-(dialkylamino)-phenyl]methanes; heterocyclic amines, amidines; cyclic amidines; guanididines; and cyclic guanidines. The particularly preferred bases are those having a pKa value of 8 or higher.

(b) Base precursors

Base precursors are preferably those precursors which undergo any reaction under heat to release a base, for example, organic acid-base salts which are decomposed or decarbonated upon heating, and compounds which are decomposed to release amines through such reactions as intramolecular nucleophilic substituting reaction, Lossen rearrangement, Beckman rearrangement, etc. The preferred base precursors include salts of trichloroacetic acid as described in British Pat. No. 998,949; salts of alphasulfonylacetic acid as described in U.S. Pat. No. 4,060,420; salts of propiolic acid as described in Japanese Patent Application No. 58-55700; 2-carboxylcarboxamide derivatives as described in U.S. Pat. No. 4,088,496; salts of thermally decomposable acids with a basic component containing an organic base and an alkali metal or alkaline earth metal as described in Japanese Patent Application No. 58-69597; hydroxamcarbamates utilizing Lossen rearrangement as described in Japanese Patent Application No. 58-43860; and aldoximcarbamates capable of forming nitriles upon heating as described in Japanese Patent Application No. 58-31614. In addition, base precursors as disclosed in British Pat. Nos. 998,945 and 2,079,480; U.S. Pat. No. 3,220,846; and Japanese Patent Application Kokai No. 50-22625, etc. are also useful.

(c) Nucleophilic compounds

Exemplary of the nucleophilic compounds there may be given water, water-releasing compounds, amines, amidines, guanidines, hydroxylamines, hydrazines, hydrazides, oximes, hydroxamic acid derivatives, sulfonamides, active methylene compounds, alcohols, and thiols, as well as salts and precursors of these compounds.

(d) Oils

Useful are those high-boiling organic solvents which are used as a solvent in emulsion dispersing a hydrophobic compound and also known as plasticizers.

(e) Thermal solvents

The thermal solvents are those compounds which are solid at an ambient temperature, but melts at approximately developing temperatures to serve as solvents. Useful are ureas, urethanes, amides, pyridines, sulfonamides, sulfones, sulfoxides, esters, ketones and ethers, provided that they are solid at temperatures of lower than 40° C.

(f) Surface-active agents

Typical surface-active agents are pyridinium salts, ammonium salts, and phosphonium salts as disclosed in Japanese Patent Application Kokai No. 59-74547, and polyalkylene oxides as disclosed in Japanese Patent Application Kokai No. 59-57231.

(g) Compounds capable of interacting with silver or silver ion

Useful are imides, nitrogen-containing heterocyclic compounds as disclosed in Japanese Patent Application No. 58-51657, thiols as disclosed in Japanese Patent Application No. 57-222247, thioureas, and thioethers.

These image formation promotors may be incorporated in the photosensitive material and/or the dye-fixing material. The particular layer into which the image formation promotors are incorporated may be any of the emulsion layer, intermediate layer, protective layer, image-receiving or dye-fixing layer, and layers adjoining any of these layers. The same applies to an embodiment where both the photosensitive layer and the dye-fixing layer are on a common support.

The image formation promotors may be used alone or in admixture of two or more. Generally, the promoting effect is enhanced by the use of more than one promotor. An outstanding promoting effect is obtained particularly when the base or base precursor is combined with another promotor.

In the practice of the present invention, a variety of development inhibitors may be used for the purpose of obtaining a consistent image irrespective of variations in treating temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds, and the like. Specific examples of the acid precursors are oxime esters as disclosed in Japanese Patent Application Nos. 58-216928 and 59-48305, and those compounds capable of releasing an acid through Lossen rearrangement as disclosed in Japanese Patent Application No. 59-85834. Specific examples of the electrophilic compounds capable of substitution reaction with a base upon heating are such compounds as disclosed in Japanese Patent Application No. 59-85836, etc. The effect of these development inhibitors is enhanced particularly when they are combined with base precursors. The proportion of the base precursor to the acid precursor used herein may preferably range from 1/20 to 20/1, and more preferably, from 1/5 to 5/1 in molar ratio.

Further, in the present invention, it is possible to use a compound which activates development simultaneously with stabilizing the image. Particularly preferred compounds used herein are isothiuroniums including 2-hydroxyethylisothiuronium trichloroacetate as described in U.S. Pat. No. 3,301,678; bisisothiuroniums including 1,8-(3,6-dioxaoctane)-bis(isothiuronium trichloroacetate) as described in U.S. Pat. No. 3,669,670; thiol compounds as described in German Patent Application (OLS) No. 2,162,714; thiazolium compounds such as 2-amino-2-thiazolium trichloroacetate, 2-amino-5-bromoethyl-2-thiazolium trichloroacetate, etc., as described in U.S. Pat. No. 4,012,260; and compounds having alphasulfonylacetate as an acid part such as bis(2-amino-2-thiazolium)-methylene-bis(sulfonylacetate), 2-amino-2-thiazolium phenylsulfonyl-acetate, etc. as described in U.S. Pat. No. 4,060,420.

Also preferred are azolthio ethers and blocked azolinthione compounds as described in Belgian Pat. No. 768,071; 4-aryl-1-carbamyl-2-tetrazoline-5-thione compounds as described in U.S. Pat. No. 3,893,859; and those compounds described in U.S. Pat. Nos. 3,839,041; 3,844,788; and 3,877,940.

The photosensitive material of the present invention may contain a toning agent if desired. Useful toning agents are phthalazinones, 1,2,4-triazoles, 1H-tetrazoles, thiouracils, 1,3,4-thiadiazoles, and similar compounds. Examples of the preferred toning agents include phthalazinone, 2-acetylphthalazinone, 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above generally ranges from about 0.001 to 0.1 mole per mole of silver in the photosensitive material although the exact content depends upon the type of a heat developable photo-sensitive material used, processing conditions, desired images and various other factors.

In the practice of the present invention, the binders may be employed alone or in combinations thereof. The preferred binder used is a hydrophilic binder. The typical hydrophilic binder is a transparent or translucent hydrophilic binder, examples of which include natural substances, for example, proteins such as gelatin, gelatin derivatives and cellulose derivatives and polysaccharides such as starch, gum arabic etc.; and synthetic polymers, for example, water-soluble polyvinyl compounds such as polyvinyl pyrrolidone, acrylamide polymer, etc. Another example of the synthetic polymer compound is a dispersed vinyl compound in a latex form which is used for the purpose of increasing the dimensional stability of a photographic material.

The high-boiling organic solvent may be dispersed in the binder together with hydrophobic compounds, for example, a dye-providing substance such that the volume of the solvent is less than about 1 cc, preferably less than about 0.5 cc, and most preferably less than about 0.3 cc per gram of the binder.

In the heat-developable photosensitive material and the dye-fixing material according to the present invention, the photographic emulsion layer, conductive layers, dye-fixing layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloyl-hexahydro-s-triazine, 1,3-vinylsulfonyl-2-propanol, 1,2-bis(vinylsulfonylacetamide)ethane, etc.; active halogen compounds such as 2,4-dichloro-6-hydroxy-s-triazine, etc.; mucohalogenic acids such as mucochloric acid, mucophenoxychloric acid, etc. or the like alone or in combinations of two or more.

The support used in the light-sensitive material of the present invention and the optional dye-fixing material must withstand the processing temperature. Exemplary of ordinary supports there may be given not only glass, paper, metal and analogues, but also an acetyl cellulose film, a cellulose ester film, a polyvinyl acetal film, a polystyrene film, a polycarbonate film, a polyethylene terephthalate film, and a film or plastic material related thereto. Further, a paper support laminated with a polymer such as polyethylene, etc. may be used. Those polyesters described in U.S. Pat. Nos. 3,634,089 and 3,725,070 are preferably used.

When a dye-providing substance which releases a mobile dye imagewise is used in the practice of the present invention, a dye transfer assistant may be used to transfer the dye from the photosensitive layer to the dye-fixing layer. The dye transfer assistants of the type supplied from outside the system include water and aqueous alkaline solutions containing sodium hydroxide, potassium hydroxide, or other inorganic alkali metal salts. Further, there may be used low boiling solvents such as methanol, N,N-dimethylformamide, acetone, diisobutyl ketone, etc., and mixtures of such a low boiling solvent with water or aqueous alkaline solution. The dye transfer assistant may be used by wetting the image receiving layer with the transfer assistant.

When the dye tranfer assistant has been incorporated into the heat-developable photosensitive material or dye-fixing material, the transfer assistant need not be supplied from the outside. The above-described dye transfer assistant may be incorporated into the material in the form of water of crystallization or microcapsules or as a precursor which releases a solvent at elevated temperatures. More preferably, a hydrophilic thermal solvent which is solid at an ambient temperature and melts at a high temperature may be incorporated into heat-developable photosensitive material or dye-fixing material. The hydrophilic thermal solvent may be incorporated in the heat-developable photosensitive material and/or the dye-fixing material. Although the solvent can be incorporated into any of the emulsion layer, intermediate layer, protective layer, and dye-fixing layer, it is preferred to incorporate it into the dye-fixing layer and/or layers adjacent thereto.

Examples of the hydrophilic thermal solvents include ureas, pyridines, amides, sulfonamides, imides, alcohols, oximes and other heterocyclic compounds.

When the dye-providing substance having general formula (L I) as defined above is contained in the heat-developable photosensitive material of the present invention, such additives as anti-irradiation and antihalation substances and various dyes need not necessarily be contained in the photosensitive material because of coloring of the dye-providing substance. For the purpose of improving the sharpness of an image, filter dyes, absorptive materials and the like may be contained as disclosed in Japanese Patent Publication No. 48-3692; U.S. Pat. Nos. 3,253,921; 2,527,583; and 2,956,879; etc. Preferred among these dyes are thermally decoloring dyes, for example, those disclosed in U.S. Pat. Nos. 3,769,019; 3,745,009; and 3,615,432.

The heat-developable photosensitive materials of the present invention may optionally contain any of a variety of additives well known for use in heat-developable photosensitive materials and possess in addition to the photosensitive layer, any layers including protective layer intermediate layer, AH layer, and release layer. Examples of the additives include such additives as disclosed in Research Disclosure, Vol. 170, June 1978, No. 7029, for example, plasticizers, sharpness improving dyes, AH dyes, sensitizing dyes, matte agents, surface-active agents, brightening agents, discoloration retarders, etc.

When the photographic elements according to the present invention contain a dye-providing substance which forms or releases a dye upon heat development. They are generally classified into two typical forms, one form having photosensitive and dye-fixing layers separately applied on two separate supports and another form having both photosensitive and dye-fixing layers applied on a common support.

The former system having photosensitive and dye-fixing layers separately applied on two separate supports is generally sub-classified into two types, peeling type and non-peel type. In the case of peeling type, the coated surface of the photosensitive element is overlapped the coated surface of the dye-fixing element after imagewise exposure or heat development, and the photosensitive element is separated from the dye-fixing element immediately after formation of a transfer image. Depending on whether the final image is of reflective or transmissive type, the support of the dye-fixing element may be selected among opaque or transparent supports. If desired, a white reflective layer may be applied. In the case of non-peel type, a white reflective layer must be interposed between the photosensitive layer of the photosensitive element and the dye-fixing layer of the dye-fixing element while the white reflective layer may be applied to either the photosensitive element or the dye-fixing element. The support of the dye-fixing element must be transparent support.

The latter system having both light-sensitive and dye-fixing elements applied on a common support is typically one wherein the photosensitive element need not be peeled from the image-receiving element after formation of a transfer image. In this case, a photosensitive layer, a dye-fixing layer, and a white reflective layer are laminated on a transparent or opaque support. The preferred arrangements are transparent or opaque support/photosensitive layer/white reflective layer/-dye-fixing layer and transparent support/dye-fixing layer/white reflective layer/photosensitive layer, to name a few.

Another typical form having both light-sensitive and dye-fixing elements applied on a common support is one wherein a release layer is applied at a proper location such that the photosensitive element may be entirely or partially separated from the dye-fixing element, as disclosed in Japanese Patent Application Kokai No. 56-67840, Canadian Patent No. 674,082, and U.S. Pat. No. 3,730,718.

When the non-peel type is employed, the conductive layer according to the present invention is disposed at such a position as not to obstruct exposure and image observation.

The dye-fixing element optionally used in the present invention has at least one layer containing a mordant. When the image-receiving or dye-fixing layer is positioned at the surface, a protective layer may further be applied thereon if necessary.

Further, in order that a dye transfer assistant may be contained in a sufficient amount or controlled, a water-absorbing layer or dye transfer assistant-containing layer may be provided. Such a layer may be applied contiguous to the dye-fixing layer or via an intermediate layer.

The dye-fixing layer used in the practice of the invention may be divided into two layers containing mordants having different mordanting power, if necessary.

The mordants contained in the dye-fixing layer is not particularly limited although polymeric mordants are particularly preferred. The polymeric mordants include poymers containing a tertiary amino group, polymers having a nitrogen-containing heterocyclic moiety, and polymers containing a quaternary cationic group.

Those polymers containing vinyl monomer units having a tertiary amino group are described in Japanese Patent Application Nos. 58-169012 and 58-166135. Those polymers containing vinyl monomer units having a tertiary imidazole group are described in Japanese Patent Application Nos. 58-30226497 and 58-232071; U.S. Pat. Nos. 4,282,305; 4,115,124; and 3,148,061. Those polymers containing vinyl monomer units having a quaternary imidazolium salt are described in U.K. Pat. Nos. 2,056,101; 2,093,041; and 1,594,961; U.S. Pat. Nos. 4,124,386; 4,115,124; 4,273,853; and 4,450,224; and Japanese Patent Application Kokai No. 48-28225. Those polymers containing vinyl monomer units having a quaternary ammonium salt are described in U.S. Pat. Nos. 3,709,690; 3,898,088; and 3,958,995; Japanese Patent Application Nos. 58-166135, 58-169012; 58-232070, 58-232072, and 59-91620.

The dye-fixing element used in the practice of the present invention may include any auxiliary layers, for example, a release layer, matte agent layer, and anti-curling layer.

One or more of the above-mentioned layers may contain a base or base precursor for promoting dye transfer, hydrophilic thermal solvent, anti-discoloration agent for preventing discoloration of dyes, UV absorber, dispersed vinyl compound for increasing dimensional stability, and brightening agent.

The binders used in the above-mentioned layers are preferably hydrophilic, and typically transparent or translucent hydrophilic colloids. Examplary of the hydrophilic binders there may be given natural substances, for example, proteins such as gelatin, gelatin derivatives, cellulose derivatives, etc, and polysaccharides such as starch, dextrin, pluran, gum arabic, etc., and synthetic polymers, for example, water-soluble polyvinyl compounds such as polyvinyl alcohol and polyvinyl pyrrolidone, acrylamide polymers, etc. Particularly useful among them are gelatin and polyvinyl alcohol.

The dye-fixing element may further include in addition to the above-mentioned layers, a reflective layer containing a white pigment like titanium oxide, neutralizing layer, neutralization timing layer or the like depending on the intended application. These layers may also be provided in the heat-developable photosensitive element as well as in the dye-fixing element. The organization of these reflective, neutralizing, and neutralization timing layers is described, among others, in U.S. Pat. Nos. 2,983,606; 3,362,819; 3,362,821; and 3,415,644; and Canadian Pat. No. 928,599.

The light source for image exposure to record an image in the heat-developable photosensitive material may be any radiation including visible light. In general, light sources used in ordinary color printing may be used, for example, tungsten lamps, mercury lamps, halogen lamps like iodine lamps, xenon lamps, laser sources, CRT sources, fluorescent lamps, light emitting diodes (LED), and the like.

The temperature at which the heat-developable photosensitive materials are heated during heat development process ranges from about 80° C. to about 250° C., preferably from about 110° C. to about 180° C., more preferably above about 140° C., and most preferably above about 150° C. in the preferred range. To carry our transfer of a dye image, the heating temperature during the transfer process ranges from room temperature to the temperature used in the heat development process, and preferably up to a temperature 10° C. lower than the heat development temperature. Heating means additionally used during the development or transfer process may be any suitable heating means other than the conductive layer according to the present invention, for example, a simple heat block, an iron, a heat roller and the like.

When water is used as the dye transfer assistant, a water softener is used in order to prevent calcium and magnesium ions in water from forming a precipitate to cause nonuniform dye transfer. Preferred examples of the water softeners which may be added for this purpose include organic phosphonic acid compounds; polyphosphoric acid compounds as exemplified by sodium hexametaphosphate, sodium tetrapolyphosphate, sodium tripolyphosphate or potassium salts of these polyphosphoric acids; aminopolycarboxylic acids as exemplified by ethylenediamine tetraacetic acid, nitrotriacetic acid, triethylenetetramine hexaacetic acid, iminodiacetic acid, hydroxyethyliminodiacetic acid, N-hydroxymethylethylenediamine triacetic acid, diethylenetriamine pentaacetic acid, cyclohexanediamine tetraacetic acid, and diaminopropanol tetraacetic acid. The amount of water softener added is not particularly limited and usually determined in accordance with the hardness of water. Generally, the water softener is added in an amount of 0.001 to 30 grams, preferably 0.01 to 10 grams per liter of water. No particular limit is imposed on the temperature of water although warm water can accelerate transfer rate.

BENEFITS OF THE INVENTION

According to the present invention, a conductive layer containing at least a conductive substance, a hydrophilic binder, and a water-insoluble compound having a melting point of up to 120° C. and a boiling point of at least 175° C. is formed on a support to produce a photographic element which is adapted for heat development or heat transfer of a mobile dye as it has the conductive layer whose resistance undergoes a very little change when folded.

EXAMPLES

Examples of the present invention are presented below by way of illustration and not by way of limitation.

Example 1

An additive dispersion, that is, a dispersion of a water-insoluble compound, trinonyl phosphate was prepared by emulsifying and dispersing a mixture of the following ingredients.

(i) 10% gelatin solution: 100 grams
(ii) 5% solution of sodium dodecylbenzenesulfonate: 20 ml
(iii) trinonyl phosphate (liquid at 10° C., b.p. above 220° C.): 20 grams
(iv) etheyl acetate: 20 ml A coating dispersion of carbon black was prepared by milling the following ingredients in a colloid mill.

| Ingredient | Amount |
|---|---|
| (a) Carbon black (average particle size 20 mμ, DBP oil absorption 320 cc/100 g) | 21 grams |
| (b) Demor N[1] | 3.6 grams |
| (c) Nissan Nonion NS208.5[2], 5% in water | 27 ml |
| (d) 10% gelatin solution | 306 grams |
| (e) Trinonyl phosphate dispersion (additive dispersion) | 65 grams |
| (f) 10% 2-ethylhexyl succinate sodium sulfonate in 1/1 water/methanol | 40 ml |
| (g) Water | 537 ml |

[1]maufactured by Kao Atlas K. K.
[2]manufactured by Nissan Chemical K. K.

The carbon black dispersion was applied onto a polyethylene terephthalate film to a wet thickness of 80 μm and dried to form a conductive layer, obtaining sample 1A. It was found that the trinonyl phosphate was present as fine droplets having an average diameter of 0.7 μm.

For comparison purposes, sample 1B was prepared by repeating the same procedure as used for sample 1A except that (e) trinonyl phosphate dispersion was omitted and instead, the 10% gelatin solution was increased from 306 grams in sample 1A to 350 grams and the water was increased from 537 ml in sample 1A to 558 ml.

Samples 1A and 1B were dried by allowing them to stand at a relative humidity (RH) of 20% for one day.

The samples were cut into strips of 2 cm by 20 cm at a relative humidity of 20%. Each strip was folded under a load of 500 grams along a line 10 cm spaced from one end such that the coating layer faced outside. The electric resistance of the strip was measured before and after folding. A resistance change is obtained as the resistance after folding divided by the resistance before folding.

| Sample | Resistance change |
|---|---|
| 1A (Invention) | 1.07 |
| 1B (Comparison) | 1.95 |

These results show that sample 1A of the present invention undergoes only a slight change in resistance by folding. This indicates that a heat-developable photosensitive material having a conductive layer prepared in this way would insure stable development even in the event of possible troubles as by folding.

Example 2

Samples 2A to 2F were prepared by repeating the same procedure as used in Example 1 except that dispersions of various water-insoluble compounds as shown in Table 1 were used as the additive dispersion (e) instead of the trinonyl phosphate dispersion used in Example 1. By following the same test procedure as in Example 1, samples 2A to 2F were determined for resistance change before and after folding.

The results are shown in Table 1.

TABLE 1

| Sample No. | Water-insoluble compound (m.p./b.p.) | Resistance change |
|---|---|---|
| 2A | tricresyl phosphate (liquid at room temp./above 235° C.) | 1.12 |
| 2B | dibutyl phthalate (liquid at room temp./above 339° C.) | 1.10 |
| 2C | trihexyl phosphate (liquid at room temp./above 190° C.) | 1.06 |
| 2E | triphenyl phosphate (49° C./above 220° C.) | 1.09 |
| 2F | oleyl benzoate (liquid at room temp./above 220° C.) | 1.13 |

As seen from the data in Table 1, samples 2A to 2F of the present invention show an outstandingly less resistance change than comparative sample 1B.

Example 3

Samples 3A to 3D were prepared by repeating the same procedure as used in Example 1 except that the amounts of ingredients (d), (e), and (g) were changed as shown in Table 2 to vary the proportion of the high-boiling solvent or water-insoluble compound relative to the gelatin binder. The resistance change was determined on these samples. The results are also shown in Table 2.

TABLE 2

| Sample No. | Amount of (d), grams | Amount of (e), grams | (g) ml | Weight ratio of high-boiling solvent/binder | Resistance change |
|---|---|---|---|---|---|
| 3A | 346 | 7.5 | 554 | 0.05 | 1.32 |
| 3B | 324 | 44 | 540 | 30 | 1.19 |
| 3C | 288 | 104 | 516 | 70 | 1.09 |
| 3D | 262 | 149 | 497 | 100 | 1.05 |
| 1B | 350 | 0 | 558 | 0 | 1.95 |

The data in Table 2 show that an outstanding effect is achieved with the high-boiling solvent or water-insoluble compound of the present invention when used in its weight ratio to the binder of 0.05 or higher.

Example 4

Samples 1A and 1B from Example 1 each having the carbon black dispersion coated thereon were coated with a photographic layer consisting of the following first (lowermost) to sixth (uppermost) layers on the support surface opposite to the carbon black coating, preparing color photosensitive materials of multi-layer structure having a conductive layer. Samples 4A and 4B were obtained from samples 1A and 1B, respectively.

[FORMULATION]

Sixth layer
- gelatin (coating weight 800 mg/m$^2$)
- base precursor*3 (coating weight 480 mg/m$^2$)
- hardener*6 (coating weight 90 mg/m$^2$)
- silica*5 (coating weight 100 mg/m$^2$)

Fifth layer: Green-sensitive emulsion layer
- silver chlorobromide emulsion (bromine 50 mol %, coating weight 400 mg/m$^2$ of Ag)
- benzenesulfonamide (coating weight 180 mg/m$^2$)
- silver benzotriazole emulsion (coating weight 100 mg/m$^2$)
- sensitizing dye D-1 (coating weight $10^{-6}$ mol/m$^2$)
- base precursor*3 (coating weight 500 mg/m$^2$)
- yellow dye-providing substance (A) (coating weight 400 mg/m$^2$)
- gelatin (coating weight 1000 mg/m$^2$)
- high-boiling solvent*4 (coating weight 800 mg/m$^2$)
- surface-active agent*2 (coating weight 100 mg/m$^2$)

Fourth layer: Intermediate layer
- gelatin (coating weight 900 mg/m$^2$)
- base precursor*3 (coating weight 450 mg/m$^2$)

Third layer: Red-sensitive emulsion layer
- silver chlorobromide emulsion (bromine 80 mol %, coating weight 300 mg/m$^2$ of Ag)
- benzenesulfonamide (coating weight 180 mg/m$^2$)
- silver benzotriazole emulsion (coating weight 100 mg/m$^2$ of Ag)
- sensitizing dye D-2 (coating weight $8\times10^{-7}$ mol/m$^2$)
- base precursor*3 (coating weight 450 mg/m$^2$)
- magenta dye-providing substance (B) (coating weight 400 mg/m$^2$)
- gelatin (coating weight 1000 mg/m$^2$)
- high-boiling solvent*1 (coating weight 600 mg/m$^2$)
- surface-active agent*2 (coating weight 100 mg/m$^2$)

Second layer: Intermediate layer
- gelatin (coating weight 200 mg/m$^2$)
- base precursor*3 (coating weight 480 mg/m$^2$)

First layer: Infrared-sensitive emulsion layer
- silver chlorobromide emulsion (bromine 50 mol %, coating weight 300 mg/m$^2$ of Ag)
- benzenesulfonamide (coating weight 180 mg/m$^2$)

silver benzotriazole emulsion (coating weight 100 mg/m$^2$ of Ag)
sensitizing dye D-3 (coating weight $10^{-8}$ mol/m$^2$)
base precursor*3 (coating weight 500 mg/m$^2$)
cyan dye-providing substance (C) (coating weight 300 mg/m$^2$)
gelatin (coating weight 1000 mg/m$^2$)
high-boiling solvent*4 (coating weight 600 mg/m$^2$)
surface-active agent*2 (coating weight 100 mg/m$^2$)
Support

*1 tricresyl phosphate $(C_7H_7O)_3P{=}O$

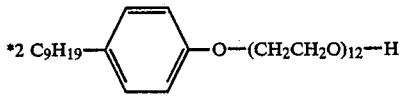

*3 guanidine 4-methylsulfonyl-phenylsulfonyl acetate
*4 $(iso\text{-}C_9H_{19}O)_3P{=}O$
*5 size 4 μm
*6 1,2-bis(vinylsulfonylacetoamide)ethane Preparation of Silver Benzotriazole Emulsion Twenty eight (28) grams of gelatin and 13.2 grams of benzotriazole were dissolved in 3,000 ml of water. The resulting solution was agitated at 40° C. A solution of 17 grams silver nitrate in 100 ml water was added to the solution over a period of 2 minutes.

The resulting silver benzotriazole emulsion was adjusted to such pH that an excess salt precipitated, and the excess salt was filtered off. The emulsion was then adjusted to pH 6.30, obtaining a silver benzotriazole emulsion in a yield of 400 grams.

Preparation of Silver Halide Emulsions

The preparation of emulsions for the fifth and third layers will be illustrated in detail.

The fifth layer silver halide emulsion was prepared by dissolving 20 grams of gelatin and 3 grams of sodium chloride in 1000 ml of water to form an aqueous gelatin solution. To the fully agitated gelating solution kept at a temperature of 75° C., 600 ml of an aqueous solution of sodium chloride and potassium bromide and another aqueous solution of 0.59 mols silver nitrate in 600 ml water were concurrently added at an equal flow rate over a period of 40 minutes. In this way, there was prepared a monodispersed cubic silver chlorobromide emulsion having an average grain size of 0.40 μm (bromine 50 mol %).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

The third layer silver halide emulsion was prepared as follows.

An aqueous gelatin solution was prepared by dissolving 20 grams of gelatin and 3 grams of sodium chloride in 1000 ml of water. To the fully agitated gelating solution kept at a temperature of 75° C., 600 ml of an aqueous solution of sodium chloride and potassium bromide and another aqueous solution of 0.59 mols silver nitrate in 600 ml water were concurrently added at an equal flow rate over a period of 40 minutes. In this way, there was prepared a monodispersed cubic silver chlorobromide emulsion having an average grain size of 0.35 μm (bromine 80 mol %).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

Dispersions of dye-providing substances in gelatin were prepared as follows.

A homogeneous solution was prepared by weighing and mixing 5 grams of yellow dye-providing substance (A) shown below, 0.5 grams of succinic acid-2-ethylhexyl ester sodium sulfonate as a surface-active agent, and 10 grams of triisononyl phosphate, adding 30 ml of ethyl acetate to the mixture, and heating the mixture to about 60° C. for dissolution. The solution was mixed with 100 grams of 10% lime-treated gelatin solution by agitation, and the mixture was then fully dispersed for 10 minutes in a homogenizer at 10,000 rpm. The resulting dispersion is designated a yellow dye-providing substance dispersion.

A magenta dye-providing substance dispersion was prepared in the same manner as above except that magenta dye-providing substance (B) shown below was used and 7.5 grams of tricresyl phosphate was used as a high-boiling solvent.

A cyan dye-providing substance dispersion was prepared in the same manner as above except that cyan dye-providing substance (C) shown below was used.

Dye-providing substance A

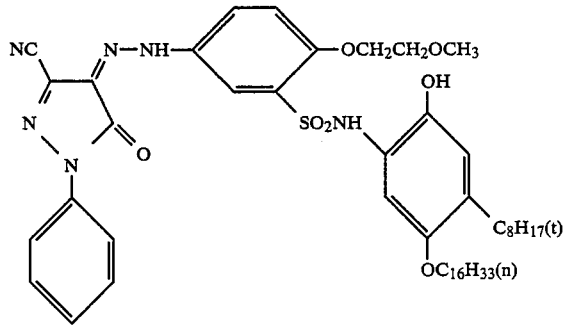

Dye-providing substance B

-continued
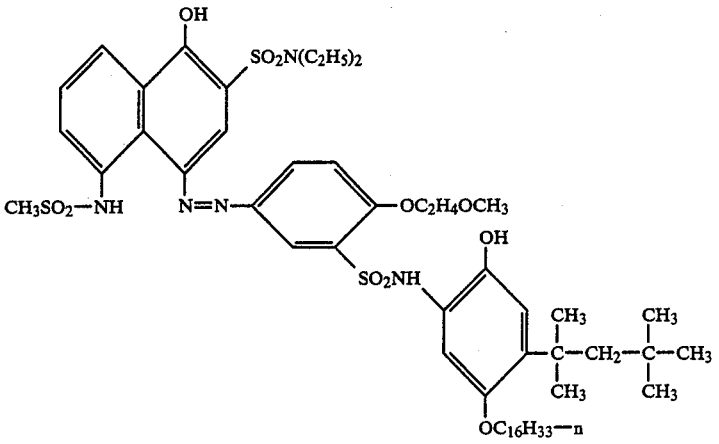
Dye-providing substance C
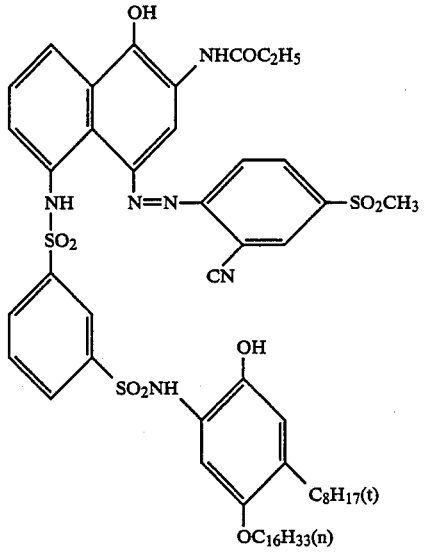
Sensitizing dye D-1
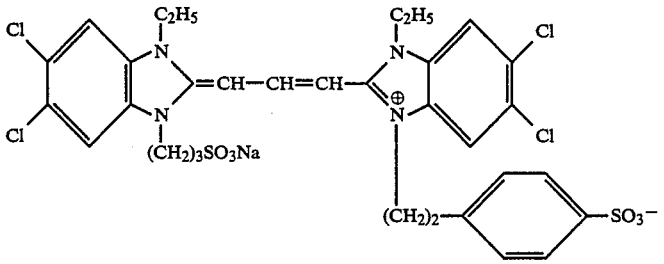
Sensitizing dye D-2
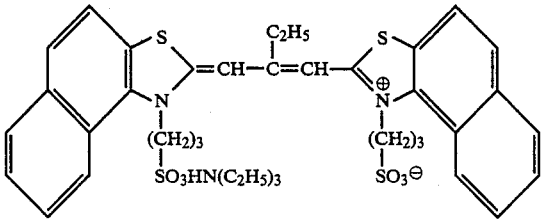
Sensitizing dye D-3

-continued

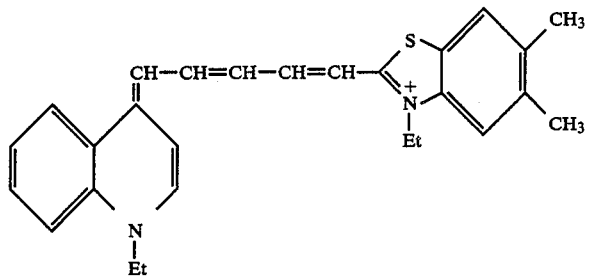

The photographic layer of each of samples 4A and 4B was exposed for one second at 500 lux under a tungsten lamp through three color separation filters G, R, and IR having a continuously varying density. It should be noted that filter G is a 500–600 nm band pass filter, filter R is a 600–700 nm band pass filter, and filter IR is a filter transmitting light having wavelengths of at least 700 nm.

Then, the exposed samples were folded and restored at a relative humidity of 20%. Thereafter, electricity was conducted across the samples at 280 V for 20 seconds using a voltage application apparatus having an electrode-to-electrode distance of 25 cm. Ten runs were made for each sample.

It was found that sample 4A (invention) was properly developed during electric conduction in all the runs. In sample 4B, electric conduction was interrupted because of breakage in six runs and sparking occurred at the fold to make fire in the remaining four runs.

These results reveal that sample 4A of the present invention can be developed in a consistent manner even under external stresses.

Sample 4A which had been developed by electric conduction was further subjected to the following treatment.

First, the preparation of a dye-fixing material used will be described.

Preparation of Dye-Fixing Material

Ten (10) grams of poly(methyl acrylate-co-N,N,N-trimethyl-N-vinylbenzylammonium chloride) having a molar ratio of methyl acrylate to vinylbenzyl ammonium chloride of 1:1 was dissolved in 200 ml of water, and the solution was homogeneously mixed with 100 grams of 10 wt % lime-treated gelatin. The resulting mixture was uniformly spread onto a paper substrate laminated with polyethylene having titanium dioxide dispersed therein, thereby forming a dye-fixing layer having a uniform wet thickness of 90 μm. The layer was dried to provide a dye-fixing material having a mordant layer.

Water was applied in an amount of 20 ml per square meter to the sensitive surface of the dye-fixing material prepared above. Sample 4A developed by electric conduction was superimposed on the dye-fixing material such that their effective surfaces faced one another. After heating on a heat block at 80° C. for 6 seconds, the dye-fixing material was peeled from sample 4A. The dye-fixing material then carried thereon yellow, magenta, and cyan color images corresponding to three color separation filters G, R, and IR.

Sample 4A had a satisfactory and clear transferred image and was free of any troubles as encountered in sample 4B although the density was found to somewhat vary across the fold when the density of the respective color images was measured by means of a Macbeth (RD 519) reflection densitometer.

As can be observed from the results of all the above experiments, the photographic element according to the present invention is effective and useful.

We claim:

1. A photographic element comprising on a support an electroconductive layer containing at least an electroconductive carbon black, a hydrophilic binder, and a water-insoluble compound having a melting point up to 50° C. and a boiling point of at least 175° C., and at least one member selected from a photosensitive layer and an image-receiving layer, wherein upon heat developing the photosensitive layer, or transferring a mobile dye resulting from heat development of the photosensitive layer to an image-receiving layer, or conducting such heat development and dye transfer at the same time, electricity is applied to the electroconductive layer to generate heat.

2. A photographic element according to claim 1 wherein said water-insoluble compound is present in the form of fine droplets.

3. A photographic element according to claim 2 wherein the fine droplets each have a size of up to 2 μm.

4. A photographic element according to claim 1 wherein said water-insoluble compound is present in the electroconductive layer in an amount of 0.01 to 3 folds the weight of said hydrophilic binder.

5. A photographic element according to claim 1 wherein said electroconductive layer contains 10 to 90% by weight of the electroconductive substance.

6. A photographic element according to claim 1 wherein said electroconductive layer has a volume resistance of 0.01 to 10 Ω-cm.

7. A photographic element according to claim 1 wherein said electroconductive layer has a thickness of up to 15 μm.

8. A photographic element according to claim 1 wherein the photosensitive layer is heat developable.

* * * * *